US007786381B2

(12) United States Patent
Henkin et al.

(10) Patent No.: US 7,786,381 B2
(45) **Date of Patent: *Aug. 31, 2010**

(54) AUTOMATIC POOL CLEANER POWER CONDUIT INCLUDING STIFF SECTIONS

(75) Inventors: Melvyn L Henkin, Ventura, CA (US); Jordan M. Laby, Ventura, CA (US)

(73) Assignee: Henkin-Laby, LLC, Ventura, CA (US)

( * ) Notice: Subject to any disclaimer, the term of this patent is extended or adjusted under 35 U.S.C. 154(b) by 953 days.

This patent is subject to a terminal disclaimer.

(21) Appl. No.: 11/601,269

(22) Filed: Nov. 18, 2006

(65) Prior Publication Data

US 2007/0062733 A1 Mar. 22, 2007

Related U.S. Application Data

(60) Division of application No. 11/123,418, filed on May 5, 2005, now Pat. No. 7,145,074, which is a continuation of application No. PCT/US03/32639, filed on Oct. 15, 2003.

(60) Provisional application No. 60/424,786, filed on Nov. 7, 2002.

(51) Int. Cl.
*H02G 3/04* (2006.01)

(52) U.S. Cl. ..... 174/68.1; 174/72 A; 174/68.3; 15/1.7; 210/167.1

(58) Field of Classification Search ..... 174/68.1, 174/68.3, 135, 72 R, 72 A; 138/120, 119; 210/169, 416.2; 15/1.7; 134/167 R; 434/21, 434/19, 92, 64.1; 285/147.3, 268, 269, 398; 362/96, 101

See application file for complete search history.

(56) References Cited

U.S. PATENT DOCUMENTS

| | | | | |
|---|---|---|---|---|
| 2,332,940 | A | 10/1943 | Senke | |
| 2,975,791 | A | 3/1961 | Pansini | |
| 3,032,044 | A | 5/1962 | Pansini | |
| 3,289,216 | A | 12/1966 | Anthony et al. | |
| 3,348,686 | A | 10/1967 | Spitzer | |
| 3,392,738 | A | 7/1968 | Pansini | |
| 3,689,408 | A * | 9/1972 | Edmiston et al. | 134/167 R |
| 3,817,382 | A | 6/1974 | Arneson | |
| 3,847,184 | A | 11/1974 | God | |
| 3,883,366 | A | 5/1975 | Blumenfeld | |
| 4,017,331 | A | 4/1977 | Thoelen, Sr. | |
| 4,839,063 | A * | 6/1989 | Brooks | 134/167 R |
| 4,881,856 | A | 11/1989 | Greig | |
| 5,082,028 | A | 1/1992 | Leonard | |
| 5,333,639 | A * | 8/1994 | Nelson | 362/96 |
| 6,090,219 | A * | 7/2000 | Henkin et al. | 134/167 R |
| 6,398,878 | B1 | 6/2002 | Henkin et al. | |
| 6,422,610 | B1 | 7/2002 | Chang | |
| 6,645,375 | B2 | 11/2003 | Henkin et al. | |
| 7,145,074 | B2 | 12/2006 | Henkin et al. | |
| 7,543,607 | B2 * | 6/2009 | Henkin et al. | 138/120 |

* cited by examiner

*Primary Examiner*—Angel R Estrada
(74) *Attorney, Agent, or Firm*—Freilich, Hornbaker & Rosen

(57) ABSTRACT

An improved power conduit for use with automatic pool cleaners particularly configured to avoid the formation of persistent coils and/or knots. Embodiments in accordance with the invention are characterized by the use of at least one axially stiff elongate member together with axially flexible and axially swivelable means for coupling said stiff member between a stationary power source fitting and a cleaner. The axially flexible and axially swivelable means can be implemented in a variety of ways, e.g., a flexible elongate hose member and a swivel coupling.

7 Claims, 7 Drawing Sheets

AUTOMATIC POOL CLEANER POWER CONDUIT INCLUDING STIFF SECTIONS

RELATED APPLICATION

This application is a division of U.S. application Ser. No. 11/123,418 filed May 5, 2005, now U.S. Pat. No. 7,145,074 which is a continuation of PCT/US03/032639 filed on 15 Oct. 2003 which claimed priority based on U.S. provisional application 60/424,786 filed on 7 Nov. 2002. This application claims priority based on all of the aforementioned applications.

FIELD OF THE INVENTION

This invention relates generally to a pool cleaner having a power conduit coupled thereto for enabling the cleaner to travel through a water pool for cleaning the water surface and/or the wall surface of a containment wall containing the water pool. More particularly, the present invention is directed to an improved conduit assembly for coupling a power source (e.g., positive pressure fluid and/or negative pressure fluid and/or electric) to a cleaner for supplying energy for propulsion and/or cleaning.

BACKGROUND OF THE INVENTION

Automatic cleaners configured to travel through a water pool for cleaning the pool water surface and/or containment wall surface are well known in the art. Such cleaners include units which operate (1) solely at the wall surface (which shall be understood to include side and floor portions), (2) solely at the water surface, or (3) selectively at the wall surface and water surface (e.g., U.S. Pat. Nos. 5,985,156; 6,039,886; 6,090,219).

Such automatic pool cleaners are generally powered by energy delivered to the cleaner via a flexible elongate conduit, e.g., a pressure hose, a suction hose, an electric wire, etc. The delivered energy functions to propel the cleaner, typically along a substantially random travel path, while pulling the conduit behind it. Regardless of the energy form used, the flexible conduit can on occasion physically interfere with and hinder the cleaner's ability to freely travel through the pool. To avoid such interference, cleaner systems are generally configured to maintain the conduit out of the normal travel path of the cleaner. For example, a conduit used with a wall surface cleaner is generally configured (i.e., effective specific gravity <1.0) to float near the water surface to avoid the cleaner having to climb over the conduit. Water surface cleaners generally use a conduit configured (i.e., effective specific gravity >1.0) to sink to the wall surface, i.e., pool floor, to avoid obstructing the cleaner. Cleaners configured to selectively travel at the water surface and wall surface preferably use a conduit configured to situate the major length of the conduit at a level between the pool water surface and containment wall surface to avoid obstructing the cleaner's movement along its travel path. The desired specific gravity for the conduit can be achieved by an appropriate choice of conduit materials and/or a proper utilization and placement of positive and/or negative buoyancy members (e.g., floats and/or weights) along the conduit length.

Typical prior art conduit assemblies are comprised of one or more elongate flexible sections which form a continuous path extending from a power source, generally via a stationary fitting mounted adjacent to the containment wall, to the cleaner. The conduit should be of sufficient length (typically, 15-45 feet) to enable the cleaner to travel to any point in the pool. A typical conduit for use with a positive pressure fluid power source comprises a hose of axially flexible material having an inner diameter of about ⅜"-1". A typical conduit for use with a negative pressure (i.e., suction) fluid source comprises an axially flexible hose having an inner diameter of about 1-2". The smaller diameter pressure hose is typically formed of soft wall material which is able to maintain easy axial flexibility in the pool environment (wet with large temperature excursions) over an extended period of time. The larger diameter suction hose is typically formed of a corrugated wall material which affords axial flexibility.

Typical prior art conduit assemblies include one or more swivels located between the power source and the cleaner to enable the conduit and/or conduit sections to swivel axially to minimize the tendency of the conduit to form persistent coils which can hinder the cleaner's freedom of movement.

Despite the aforementioned efforts to prevent the cleaner from engaging the conduit and efforts to facilitate conduit axial flexibility and axial swivelability, in practice, a typical conduit over an extended period of operation may develop persistent coils and/or knots which can hinder the cleaner's ability to freely and fully travel throughout the pool.

SUMMARY OF THE INVENTION

The present invention is directed to an improved power conduit for use with automatic pool cleaners particularly configured to avoid the formation of persistent coils and/or knots.

Whereas prior art conduits are characterized by the use of elongate hoses which exhibit substantially uniform axial flexibility along substantially their entire length, embodiments of the present invention are configured to restrict axial flexibility to designated locations spaced along the conduit length. In other words, embodiments in accordance with the invention are characterized by the use of at least one axially stiff elongate section in combination with axially flexible and axially swivelable means for coupling said stiff section between a stationary power source fitting and a cleaner. The axially flexible and axially swivelable means can be implemented in a variety of ways. For example, the desired axially flexible and swivelable behavior can be afforded by an integrated universal joint, e.g., ball, or by separate devices such as a soft hose or a hinge affording axial flexibility and a sleeve swivel affording axial swivelability.

The stiff elongate section in accordance with the invention provides a large moment arm assuring the production of sufficient torque around the swivelable means to assure adequate axial swiveling between the cleaner and the power source to thus avoid the formation of persistent coils and/or knots.

A preferred conduit embodiment in accordance with the invention is comprised of two or more elongate axially stiff sections arranged in series with an axially flexible and axially swivelable means. Axial flexibility is preferably provided by a flexible elongate section and axial swivelability by a sleeve swivel. Multiple elongate stiff sections and flexible sections are arranged in series to form a length sufficient to extend between a stationary power source fitting and a cleaner configured to travel throughout a water pool.

In a preferred implementation for use with a positive pressure power source (e.g., water pump), each stiff elongate section comprises a substantially rigid tube defining a central lumen for carrying a fluid (e.g., water) under positive pressure and each flexible elongate section a soft hose which also defines a central lumen for carrying the positive pressure fluid. The preferred implementation is comprised of alternating rigid tubes and soft hoses connected between a stationary power source fitting and a cleaner. The lengths of the rigid tubes are preferably considerably greater than the lengths of the soft hoses between adjacent rigid tubes. For example, a typical embodiment uses rigid tubes having a length of about four feet, connecting soft hoses having a length of about 1½ feet, and longer proximal and distal soft hose lengths respectively coupled to the power source fitting and to the cleaner.

In operation, as the cleaner travels along a substantially random path through the pool, it pulls the conduit and continually reorients the stiff members relative to one another. This action produces a dynamic display of randomly oriented essentially straight line segments (i.e., the stiff elongate members) which is visually interesting and pleasing. The visual aspects of the display can be enhanced by illuminating the sections, e.g., by providing an illumination source on each stiff section. Such sources can comprise an electrically energizable element such as a bulb, LED, etc., or a light energizable surface such as photoluminesent material mounted on the stiff section exterior surface which absorbs light energy during daylight and glows after dark

DETAILED DESCRIPTION

Figure 1:
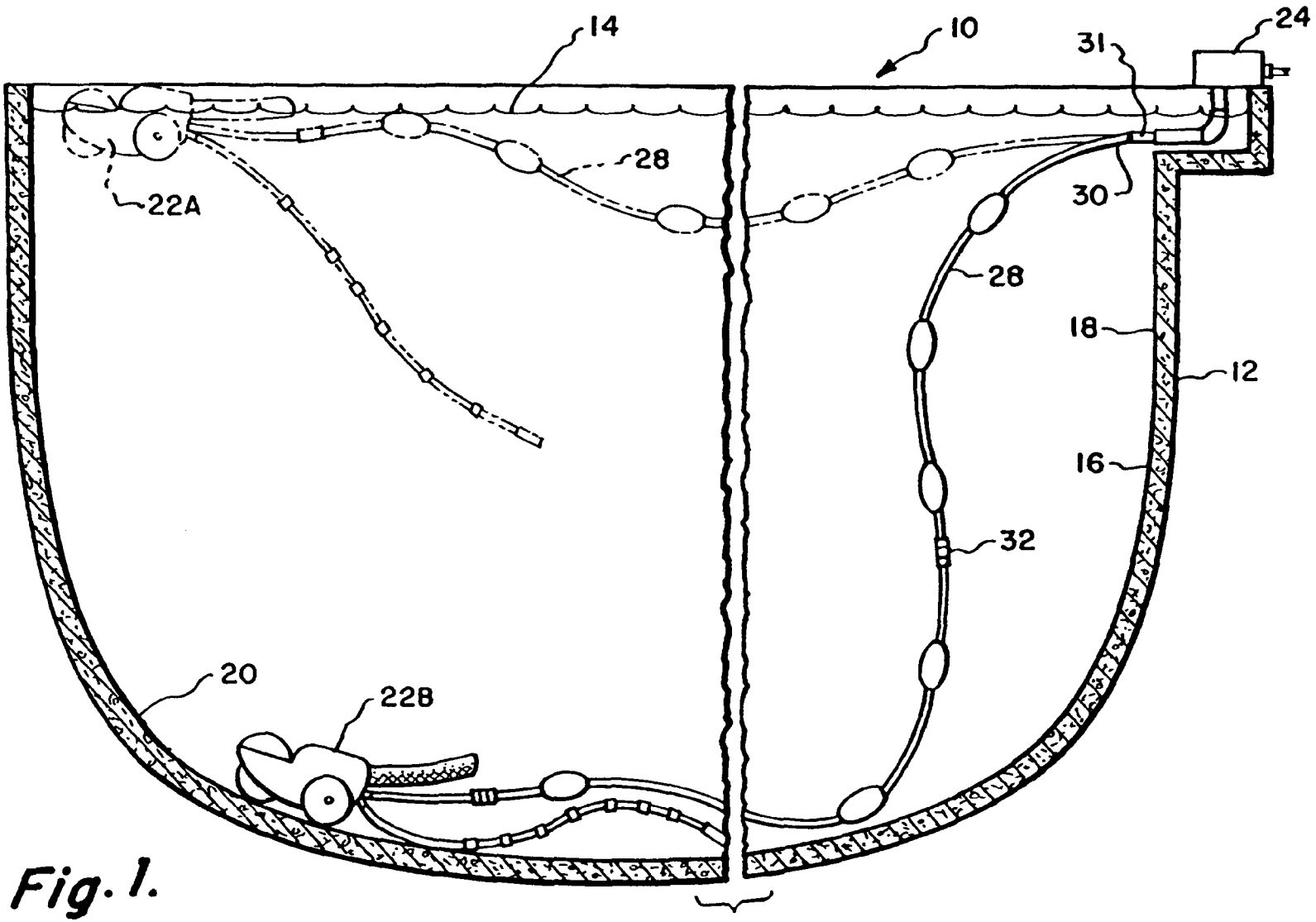
FIG. 1 is a side sectional view schematically representing a water pool showing an exemplary pool cleaner tethered to a power source via a prior art flexible conduit.
Figure 2:
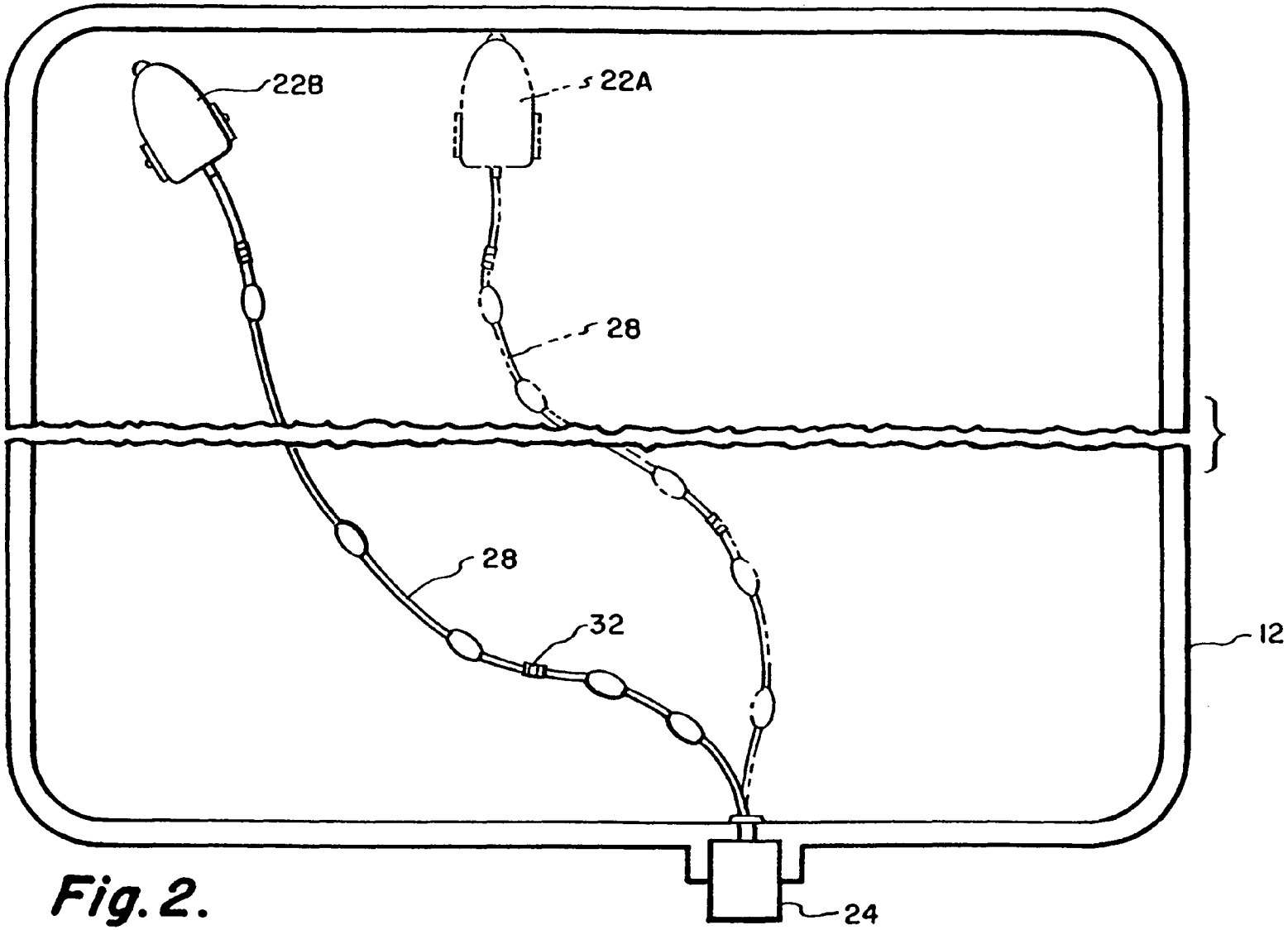
FIG. 2 is a plan view of the prior art pool cleaning system depicted in FIG. 1.

Attention is initially directed to FIGS. 1 and 2 which schematically illustrate a conventional water pool 10 contained by a containment wall 12. The pool 10 defines a water surface 14 and the wall 12 defines a wall surface 16 including side portions 18 and a bottom or floor portion 20.

Many automatic pool cleaners are described in the literature which include a cleaner body for traveling through a pool for cleaning a pool's water surface 14 and/or wall surface 16. FIGS. 1 and 2 schematically depict an exemplary pool cleaner body 22 (shown in dashed line 22A) configured to travel along the water surface 14 and an exemplary pool cleaner body 22 (shown in solid line 22B) configured to travel along the wall surface 16. It should be understood that the cleaner bodies (hereinafter, generally referred to as "cleaners") schematically represented at 22A and 22B can comprise separate alternative physical units or the same physical unit operating in different modes; i.e., in a water surface mode (22A) and wall a surface mode (22B). Typically, the pool cleaner 22 is coupled to a deck mounted power source 24 which supplies power to the cleaner via a flexible elongate conduit 28. Power supplied to the cleaner 22 typically functions to propel the cleaner through the pool along a travel path enabling it to capture water and debris as it moves along the path pulling the conduit behind it.

Various types of power sources 24 have been used in the prior art for powering pool cleaners. For example, power source 24 can supply a positive pressure fluid (typically water) to cleaner 22 via conduit 28. Alternatively, power source 24 can apply a negative pressure (i.e., suction) to cleaner 22 via conduit 28. Still further, power source 24 can supply an electric voltage to cleaner 22 via conduit 28, configured as an electric wire.

FIGS. 1 and 2 depict a conduit 28 as having a first or proximal end 30 coupled to the power source 24 via a stationary fitting 31 mounted adjacent to the wall portion 18 of wall surface 16. The second or distal end of the conduit 28 is coupled to the cleaner 22. Prior art conduits 28 intended to operate with wall surface cleaners are generally configured to float near the water surface to avoid obstructing the cleaner as it travels along the wall surface. On the other hand, conduits intended to operate with water surface cleaners may be configured to sink to avoid obstructing the movement of the cleaner along its water surface travel path. An exemplary positive pressure conduit can be comprised of multiple flexible sections, typically about 10 feet in length, connected together in series by fixed and/or swivel couplings 32.

Swivel couplings are intended to allow conduit sections to swivel axially relative to one another and to the stationary fitting 31 and cleaner 22 to prevent the formation of coils in the conduit. That is, as the cleaner travels along its generally random path, the conduit 28 is subjected to various forces e.g., axial twisting forces, which, if not relieved by relative axial swiveling will act to coil the conduit. Normally, the cleaner propulsion force pulling axially on the conduit is adequate to produce sufficient swiveling at the swivel couplings to straighten the conduit and avoid significant coiling. However, over extended periods of operation, it is not unusual for coils to form in prior art conduits which are not readily removed by the axial pulling force provided by the cleaner. The formation of persistent coils in the conduit hinders the cleaner's ability to freely and fully travel throughout the pool. Similarly, the formation of knots in the conduit, attributable to the cleaner passing over and then under the conduit will also hinder the cleaner's ability to freely and fully travel throughout the pool.

The present invention is directed primarily to an enhanced conduit assembly particularly configured to avoid the formation of persistent coils and knots to thereby facilitate the cleaner traveling unhindered throughout the pool. Embodiments of the invention are compatible with cleaners configured to operate (1) solely at the wall surface, (2) solely at the water surface, and (3) selectively at the water surface and wall surface and also with a variety of power sources including positive pressure fluid, negative pressure fluid, and electric.

A conduit assembly in accordance with the present invention, is comprised of one or more elongate axially stiff, e.g., rigid, sections connected in series with axially flexible and axially swivelable mechanisms, between a stationary power source fitting and a cleaner. A conduit assembly 50 in accordance with the invention is illustrated in FIGS. 3 and 4, which are identical to FIGS. 1 and 2, respectively, except for the details of the illustrated conduit assembly.

Figure 3:
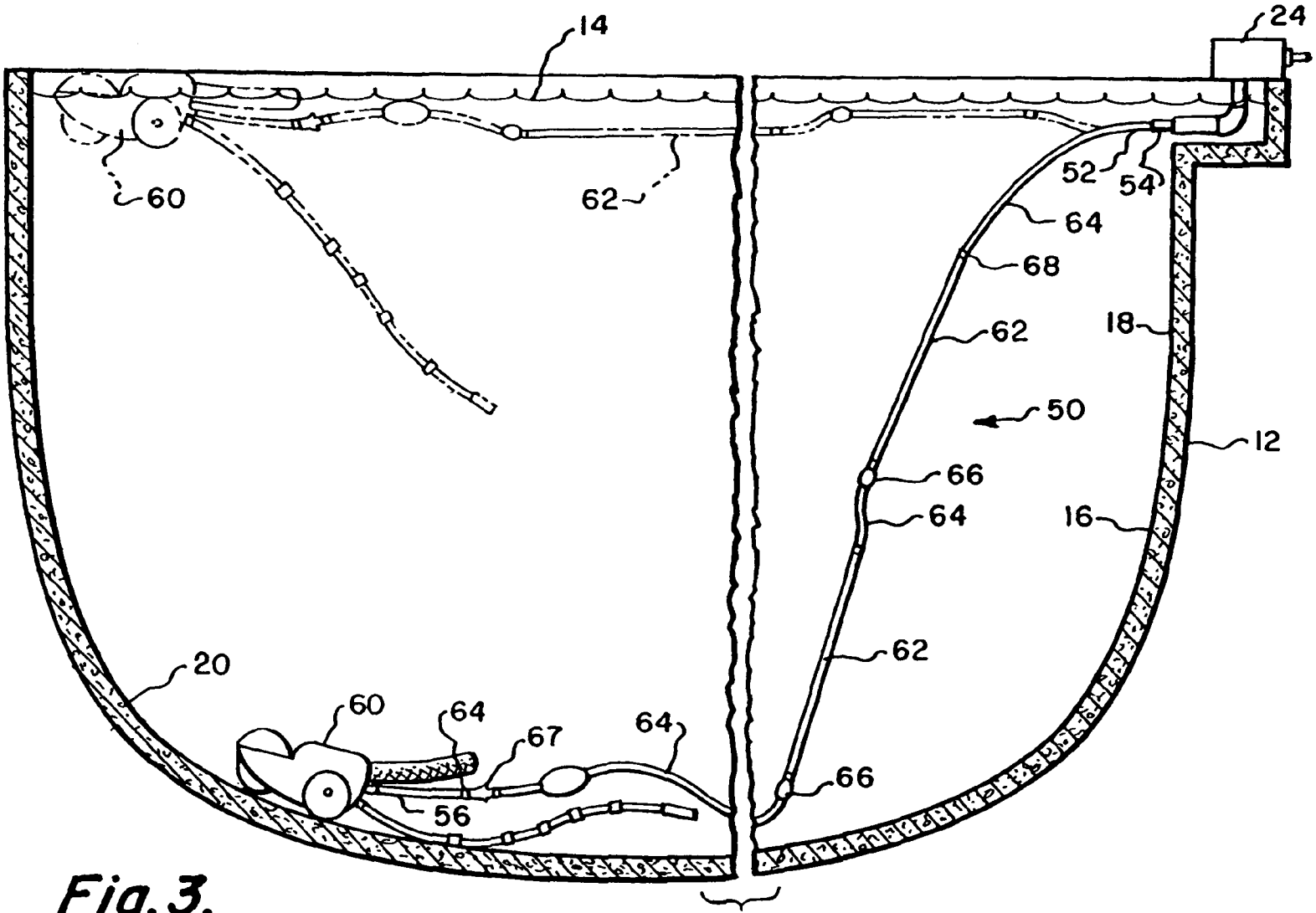
FIG. 3 is a schematic representation similar to FIG. 1 showing a preferred conduit assembly in accordance with the present invention including stiff elongate members.
Figure 4:
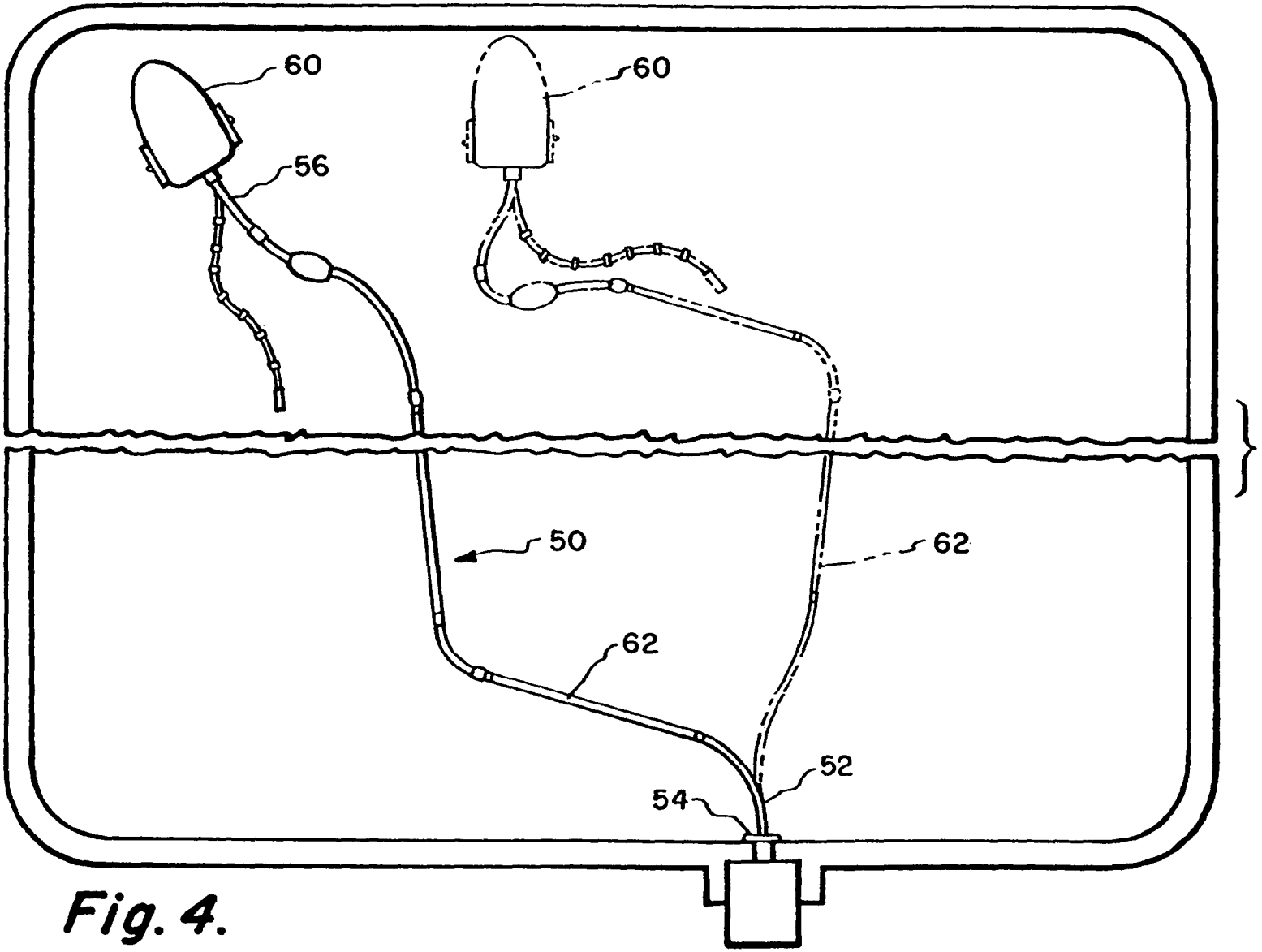
FIG. 4 is a plan view of the system depicted in FIG. 3.

Note in FIGS. 3 and 4 that the proximal end 52 of the conduit assembly 50 is coupled to stationary fitting 54 typically mounted proximate to the containment wall surface. The distal end 56 of the conduit assembly is coupled to the cleaner 60 for supplying energy thereto. The conduit assembly 50 depicted in FIGS. 3 and 4 is comprised of elongate axially stiff sections 62, e.g., rigid tubes; elongate axially flexible members, e.g., soft hose lengths, 64; axially swivelable couplings 66; and fixed couplings 68.

Optionally, the conduit assembly 50 can incorporate one or more propulsion devices 67 along its length for producing a thrust to reduce the drag of the conduit assembly on the cleaner 60. For example, the propulsion device 67 shown in FIG. 3 can be configured to produce a thrust on the conduit tending to move it toward the cleaner. In a positive pressure embodiment, the device 67 can discharge a water stream by extracting a small portion of the water flow being delivered by the conduit to the cleaner. In a suction and/or electric embodiment, thrust can be produced, for example, by a propeller driven by a small turbine or motor.

Figure 5:
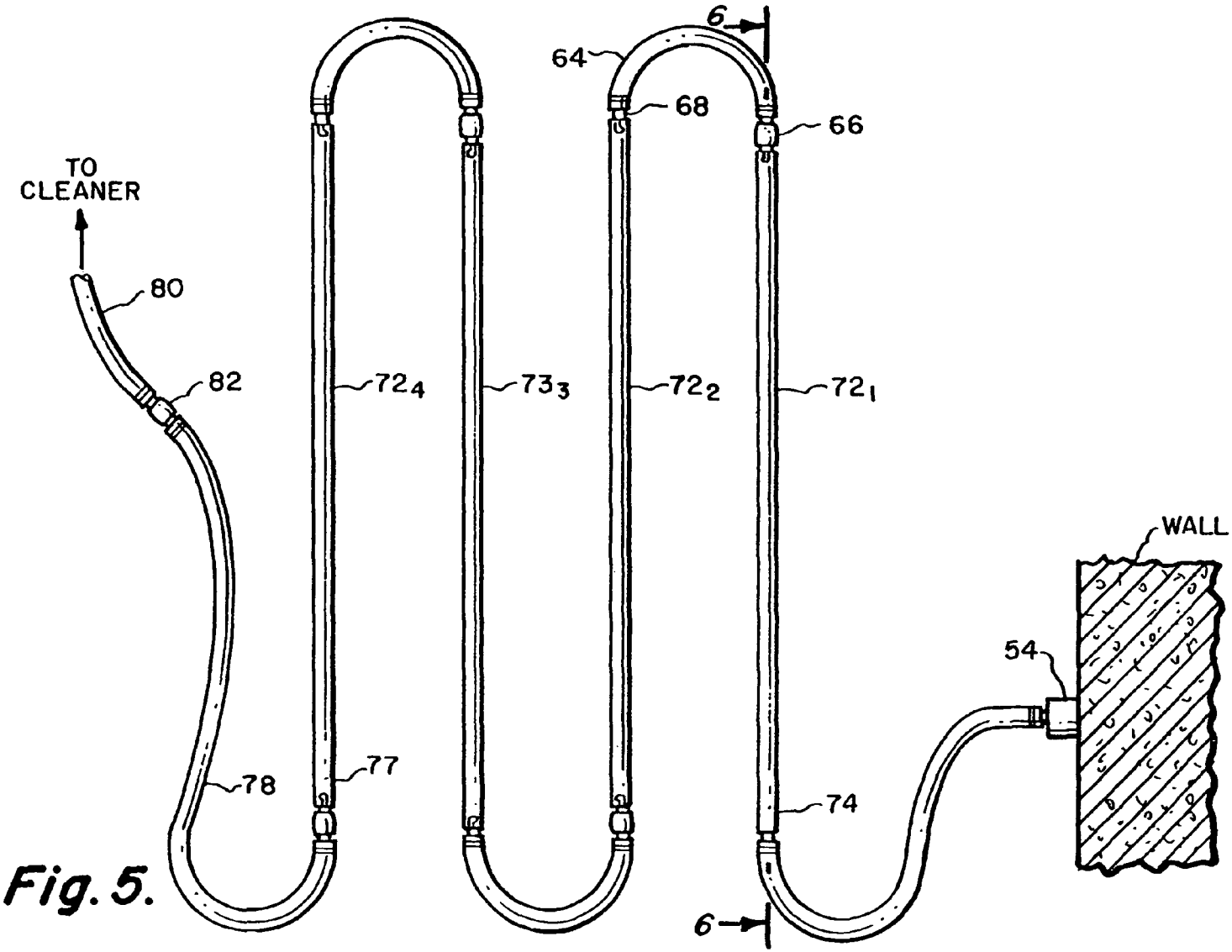
FIG. 5 is an enlarged schematic representation of the preferred conduit assembly of FIGS. 3 and 4.

Attention is now directed to FIG. 5 which depicts a preferred conduit assembly embodiment comprised of multiple modules, 72 where each module (i.e., $\mathbf{72}_1$, $\mathbf{72}_2$, $\mathbf{72}_3$, $\mathbf{72}_4$) includes an elongate axially stiff member 62 and an elongate axially flexible member 64 coupled in tandem by an axially swivelable coupling 66. Adjacent modules 72 are connected in series by fixed couplings 68. The proximal end 74 of module $\mathbf{72}_1$ is coupled to stationary fitting 54 by an elongate axially flexible member 76. The distal end 77 of module $\mathbf{72}_4$ is coupled to the cleaner via axially flexible members 78 and 80, coupled by a swivel coupling 82.

The aforementioned elements are connected in series to form a conduit length appropriate to the size of the pool to be cleaned to enable the cleaner to travel to any point in the pool. Typical embodiments of the invention will have conduit lengths within a range of about 15-45 feet and will include stiff members having lengths greater than 1½ feet.

Figure 6:
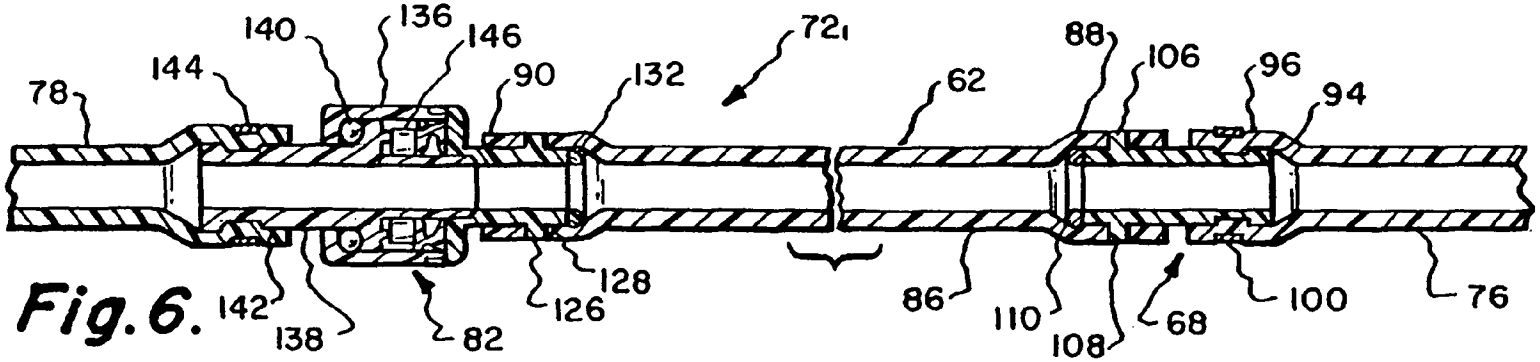
FIG. 6 is an enlarged sectional view taken substantially along the plane 6-6 of FIG. 5 showing how elongate members are coupled in series.
Figure 7:
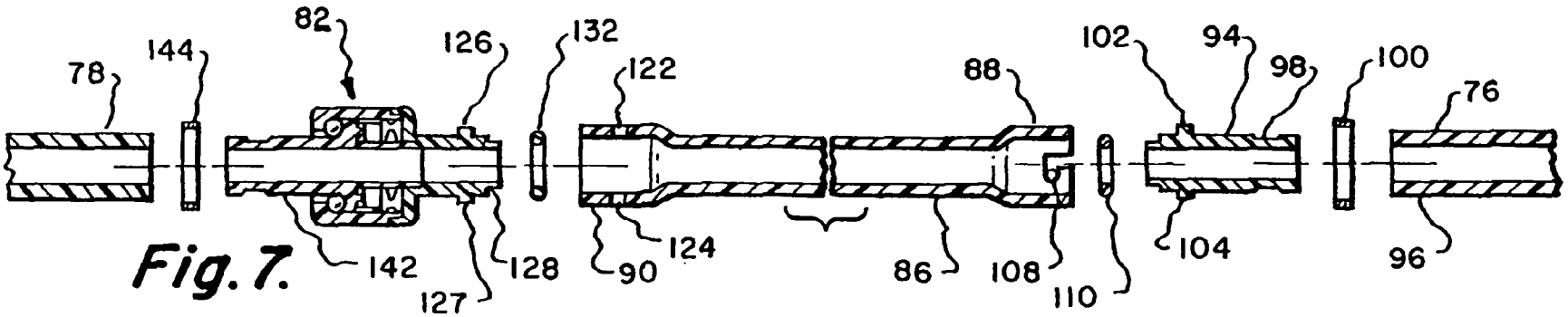
FIG. 7 is an exploded view of the coupling means of FIG. 6.

FIGS. 6 and 7 illustrate the structural details of a module $\mathbf{72}_1$ configured for use with a positive pressure fluid source. The module $\mathbf{72}_1$ includes an elongate axially stiff member 62 comprising a rigid tube 86 preferably having outwardly flared ends 88, 90. The tube 86 can be formed of any stiff material, e.g., PVC, and will be assumed to have an inner diameter of about ⅜"-1" for positive pressure applications. The proximal end 88 of tube 86 is shown coupled to flexible member 76 by a fixed coupling 68 comprising a short rigid tube 94. The tube 94 is dimensioned so that the end 96 of flexible member 76 fits snugly therearound. The proximal end of the tube 94 is preferably provided with a circumferential groove 98 formed on the outer surface thereof. A band 100 is secured around flexible member 76 to clamp the end 96 to the groove as shown in FIG. 6.

The distal end of coupling tube 94 is provided with a pair of radial pins 102, 104 adapted to be received within slots 106, 108 formed in the flared end 88 of rigid tube 86, to form a "bayonet" connection. A sealing washer 110 is preferably captured between the distal end of tube 94 and the flared interior surface of tube 86 to prevent leakage.

The distal end 90 of rigid tube 86 is slotted at 122, 124 for receiving in a "bayonet" connection pins 126, 127 extending radially from the tubular end 128 of swivel coupling 82. The tubular end 128 is dimensioned to be snugly accommodated in flared end 90 of rigid tube 86 and to capture a sealing washer 132 therebetween.

The swivel coupling 82 is comprised of an outer housing 136 axially aligned with an inner body 138. Bearings 140 contained between the housing 136 and body 138 permit the housing and body to swivel axially relative to one another. The outer housing 136 is preferably formed integral with the aforementioned tubular end 128. The inner body 138 is preferably formed integral with a tubular end 142 having a circumferential groove formed therein for clamping to the proximal end of axially flexible member 78 using clamping band 144. Additional sealing material 146 is disposed between housing 136 and body 138 to prevent leakage.

In the operation of the pool cleaning system depicted in FIGS. 3 and 4, the cleaner 60 will be propelled by energy delivered from the power source 24 via the conduit 50. As the cleaner is propelled along its travel path through the pool, it will pull the distal conduit end 56 axially causing the rest of the conduit to follow. The path of the cleaner will be defined by a multiplicity of forces including the direction of the propulsion force on the cleaner body, the contours of the wall surface, the drag forces created by the conduit, etc. Small forces act on the elongate stiff members 62 as they follow the travel path with sufficient leverage to assure adequate torque around the swivel couplings 66 to prevent the formation of persistent coils and/or knots. Moreover, the stiff members 62 experience lateral forces as they move through the pool as a consequence of their being axially non-compliant. These lateral forces create additional tension in the conduit tending to pull it straight to unwind coils and twists therein.

Figures 8A, 8B, 8C, 8D:
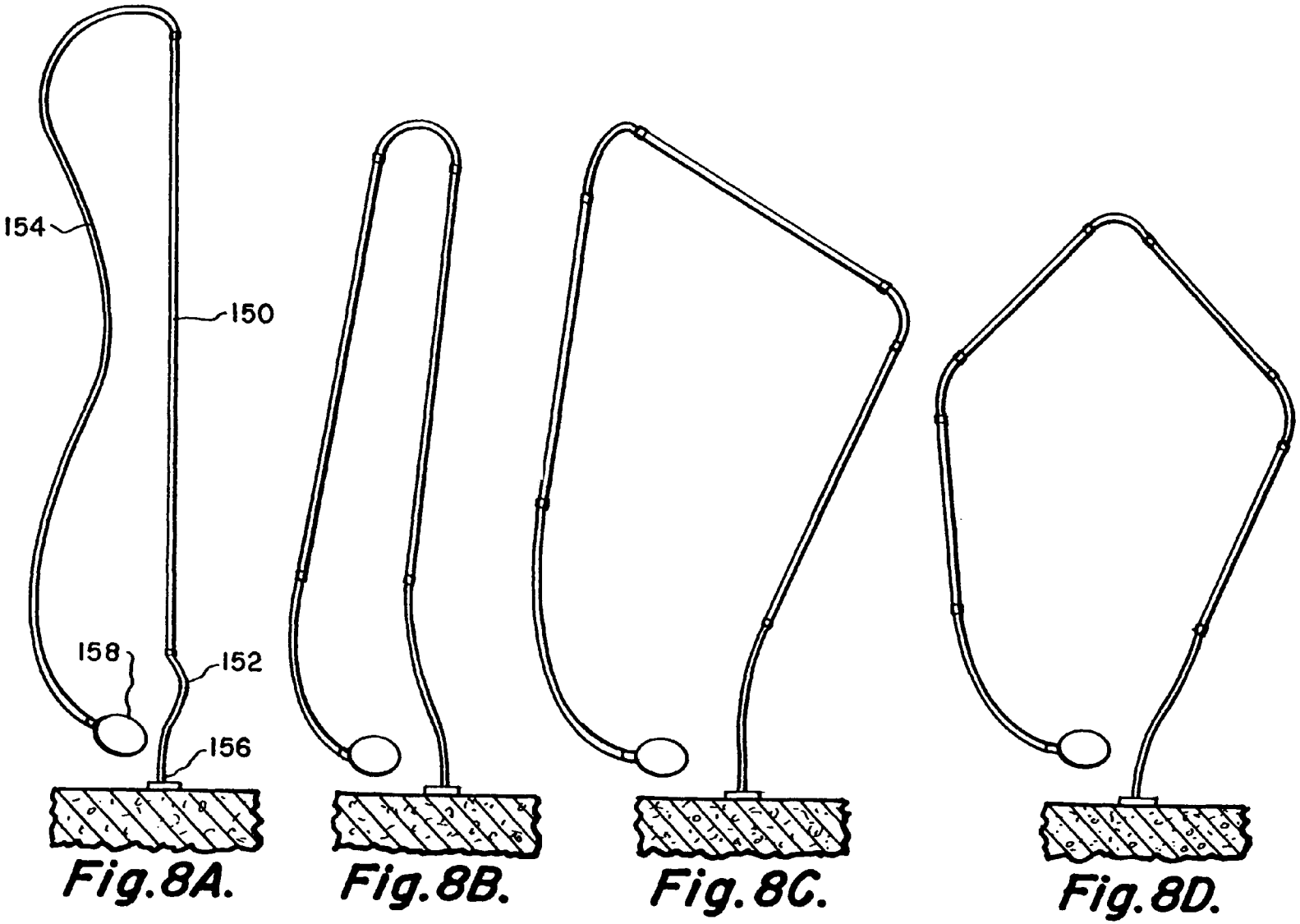
FIGS. 8A, 8B, 8C, 8D schematically represent various conduit assembly configurations in accordance with the invention.

FIGS. 3-7 illustrate a preferred conduit embodiment in accordance with the invention for a typical pool configuration. Many other variations can be used. For example, FIG. 8A shows an arrangement where a single long elongate axially stiff member 150 is connected between first and second axially flexible members 152 and 154 respectively coupled to the stationary fitting 156 and cleaner 158. FIGS. 8B, 8C, and 8D respectively show alternative configurations in which the conduit includes two, three, and four stiff members. In all cases, the stiff members are separated by axially flexible means, shown as elongate flexible members. The dimensions of the stiff members and flexible members should be selected to enable the cleaner to travel to any point in the pool, including being able to reach the location of the stationary fitting.

In operation, as the cleaner travels along a substantially random path through the pool, it pulls the conduit and continually reorients the stiff members relative to one another. This action produces a dynamic display of randomly oriented essentially straight line segments (i.e., the stiff elongate members) which is visually interesting and pleasing. The visual aspects of the display can be enhanced by illuminating the sections, e.g., by providing an illumination source on each stiff section. Such sources can comprise an electrically energizable element such as a bulb, LED, etc., or a light energizable surface such as photoluminesent material mounted on the stiff section exterior surface which absorbs light energy during daylight and glows after dark.

It is pointed out that embodiments of the present invention are compatible with the teachings of applicant's U.S. application Ser. No. 10/133,088 which describes attaching buoyancy (positive or negative) members to the conduit for situating the conduit at a level between the pool water surface and wall surface to avoid obstructing the cleaner's travel.

Although applicants have disclosed a limited number of embodiments herein, it should be understood that many other variations can be used within the scope of the invention. For example, although the mechanism to introduce axial flexibility has been illustrated as comprising an elongate flexible member such as a soft hose, other devices can be used for axial flexibility, e.g., a universal joint. Similarly, although the illustrated embodiments have introduced axial swivelability by incorporating swivel couplings distributed along the length of the embodiment, swivelability can be introduced at the power source end and/or the cleaner end, e.g., a swivel coupling can be integrated into the stationary fitting proximate to the wall surface and/or integrated into the cleaner assembly. Moreover, although the illustrated embodiments use separate elements to introduce axial flexibility (i.e., elongate flexible members) and axial swivelability (i.e., swivel couplings), it is recognized that these degrees of freedom can be integrated in appropriate alternative mechanisms, e.g. ball joint.

Accordingly, from the foregoing, it should be understood that applicants have described an automatic pool cleaning system characterized by a conduit for transferring energy from a power source to a pool cleaner where the conduit includes at least one axially stiff elongate member and axially flexible and/or axially swivelable means for minimizing the formation of persistent coils in the conduit.

The invention claimed is:

1. A power conduit for supplying energy to a pool cleaner body to cause said body to travel through a water pool along a substantially random travel path and to capture debris as it moves along said path, while avoiding the formation of persistent coils or knots in the conduit, said conduit comprising:

first and second axially stiff elongate members each having first and second ends spaced by greater than one foot, each of said stiff elongate members configured to transfer energy therealong from its said first to its said second end;

an axially flexible elongate member having first and second ends and configured to transfer energy therealong from its said first to its said second end;

said first and second axially stiff members being respectively connected to said first and second ends of said axially flexible member to form a continuous energy transfer path for transferring energy from said first axially stiff member first end to said second axially stiff member second end;

a proximal coupler for coupling said first axially stiff member first end to a stationary fitting;

a distal coupler for coupling said second axially stiff member second end to said cleaner body;

a swivel coupling in said conduit for enabling at least one of said axially stiff members to swivel axially relative to said fitting and said cleaner body; and an axially flexible coupling in said conduit for enabling at least one of said axially stiff members to variably angulate relative to said fitting and said cleaner body.

2. The conduit of claim 1 wherein each of said axially stiff members comprises a rigid tube defining an interior flow path: and wherein said axially flexible member comprises a flexible hose defining an interior flow path coupled in series with the interior flow paths of said first and second axially stiff members.

3. The conduit of claim 1 wherein said axially flexible member has a length shorter than either of said axially stiff.

4. The conduit of claim 1 wherein at least one of said stiff sections includes an electrically conductive path.

5. The conduit of claim 1 wherein at least one of said stiff sections carries a source of illumination.

6. In combination:

a pool cleaner body responsive to energy supplied thereto for moving through a water pool along a substantially random travel path and for capturing debris as it moves along said path;

a stationary fitting for supplying energy; and a conduit configured to couple energy from said stationary fitting to said cleaner body for enabling said body to move along said travel path without forming persistent coils or knots in said conduit, said conduit comprising:

first and second axially stiff elongate members each having a length greater than one foot and configured to transfer energy therealong from a first end to a second end;

a first axially flexible elongate member having first and second ends and configured to transfer energy therealong from its said first to its said second end;

said first and second axially stiff members being respectively connected to said first and second ends of said axially flexible member to form an end transfer path for transferring energy from said first axially stiff member first end to said second axially stiff member second end;

a proximal coupling means for coupling said first axially stiff member first end to a stationary fitting; and a distal coupler for coupling said second axially stiff member second end to said cleaner body;

a swivel coupling in said conduit for enabling at least one of said axially stiff members to swivel axially relative to said fitting and said cleaner body; and an axially flexible coupling in said conduit for enabling at least one of said axially stiff members to variably angulate relative to said fitting and said cleaner body.

7. The conduit of claim 6 wherein each of said axially stiff members comprises a rigid tube defining an interior flow path; and wherein said axially flexible member comprises a flexible hose defining an interior flow path coupled in series with the interior flow paths of said first and second axially stiff members.

* * * * *